US009933719B2

(12) United States Patent
Furukawa et al.

(10) Patent No.: US 9,933,719 B2
(45) Date of Patent: Apr. 3, 2018

(54) TONER FOR DEVELOPING ELECTROSTATIC IMAGE

(71) Applicant: Konica Minolta, Inc., Tokyo (JP)

(72) Inventors: Junichi Furukawa, Hachioji (JP); Tatsuya Fujisaki, Hino (JP); Naoki Yoshie, Ibaraki (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/267,628

(22) Filed: Sep. 16, 2016

(65) Prior Publication Data

US 2017/0277053 A1 Sep. 28, 2017

(30) Foreign Application Priority Data

Mar. 24, 2016 (JP) ..... 2016-059379

(51) Int. Cl.

| | |
|---|---|
| ***G03G 9/087*** | (2006.01) |
| ***G03G 9/08*** | (2006.01) |
| ***G03G 9/093*** | (2006.01) |

(52) U.S. Cl.

CPC ..... *G03G 9/08797* (2013.01); *G03G 9/0821* (2013.01); *G03G 9/08711* (2013.01); *G03G 9/08755* (2013.01); *G03G 9/08788* (2013.01); *G03G 9/08793* (2013.01); *G03G 9/08795* (2013.01); *G03G 9/09328* (2013.01); *G03G 9/09364* (2013.01); *G03G 9/09371* (2013.01)

(58) Field of Classification Search

CPC ..... G03G 9/08755; G03G 9/08708

See application file for complete search history.

(56) References Cited

U.S. PATENT DOCUMENTS

2015/0118613 A1* 4/2015 Nosella ..... G03G 9/08711 430/109.3

FOREIGN PATENT DOCUMENTS

| | | | | |
|---|---|---|---|---|
| JP | 2004-264320 A | | 9/2004 | |
| JP | 4768596 | * | 9/2011 | ..... G03G 9/087 |
| JP | 2012-022313 A | | 2/2012 | |
| JP | 2014-059489 A | | 4/2014 | |
| JP | 2014-089434 A | | 5/2014 | |
| JP | 2015-004723 A | | 1/2015 | |
| JP | 2015-042737 A | | 3/2015 | |
| JP | 2015-072442 A | | 4/2015 | |
| JP | 2015064449 A | | 4/2015 | |
| WO | 2002/084408 A1 | | 10/2002 | |

OTHER PUBLICATIONS

Publication of JP 4571975 published Oct. 2010.*

Notification of Reasons for Refusal dated Feb. 14, 2017 from corresponding Japanese Patent Application No. 2016-059379; English translation of Notification of Reasons for Refusal; Total of 21 pages.

Decision of Rejection dated May 16, 2017 from corresponding Japanese Patent Application No. 2016-059379 and English translation; Total of 8 pages.

* cited by examiner

*Primary Examiner* — Peter L Vajda

(74) *Attorney, Agent, or Firm* — Lucas & Mercanti, LLP

(57) ABSTRACT

A toner for developing an electrostatic image includes a toner particle. The toner particle includes a binder resin and a black colorant. The binder resin includes a crystalline resin component. A toner layer formed through a deposition of the toner on a glass sheet in an amount of 6.5 g/m$^2$ exhibits a light transmittance of 1 to 3% at a wavelength of 690 nm after applying heat at a temperature of 185° C. for five seconds to the toner layer from a position 100 μm away from a surface of the toner layer.

11 Claims, No Drawings

TONER FOR DEVELOPING ELECTROSTATIC IMAGE

BACKGROUND OF THE INVENTION

1. Field of the Invention

The present invention relates to a toner for developing an electrostatic image. In particular, the present invention relates to a toner for developing an electrostatic image, the toner having superior low-temperature fixing properties and capable of forming an image of uniform density.

2. Description of Related Art

Electrophotographic imaging apparatuses require a toner for developing an electrostatic image (hereinafter may be referred to simply as "toner") having superior low-temperature fixing properties in view of high image forming rate and energy saving for a reduction in environmental load.

In addition to an improvement in low-temperature fixing properties, such a toner is required to form high-quality images. In particular, a toner used for a paper sheet having an uneven thickness (e.g., a paper sheet composed of softwood fiber having a large diameter) is demanded to have superior physical properties for forming an image of improved quality because such a paper sheet may cause the uneven density of a toner image.

For example, Japanese Patent Application Laid-Open Publication No. 2015-64449 discloses a toner used for a paper sheet having an uneven thickness, the toner containing an amorphous polyester resin that forms ionic crosslinks by aluminum. This toner has pressure dependence. In detail, the toner exhibits low viscosity at a thick portion of a paper sheet because the thick portion comes into contact with a fixing member during fixation and receives a large amount of pressure from the fixing member, resulting in breakage of ionic crosslinks. In contrast, the toner maintains high viscosity at a thin portion of the paper sheet because the thin portion does not come into contact with the fixing member and receives a small amount of pressure, resulting in remaining ionic crosslinks. The high-viscosity toner remaining at the thin portion probably prevents the flow of the low-viscosity toner into the thin portion, resulting in small difference in amount of the toner between the thin and thick portions.

Unfortunately, the melting of the toner by heating during fixation has not been taken into consideration. The pressure-dependent toner hardly melts and forms a layer at the thin portion because the thin portion does not come into contact with the fixing member and receives a small amount of heat during fixation. Thus, the toner exhibits unsatisfactory low-temperature fixing properties.

The viscoelasticity of the toner disclosed in Japanese Patent Application Laid-Open Publication No. 2015-64449 is measured under conditions different from those under which the toner melts by heating during fixation. Thus, it is unclear whether the toner melts to form an image of uniform density.

SUMMARY OF THE INVENTION

An object of the present invention, which has been conceived in light of the problems and circumstances described above, is to provide a toner for developing electrostatic images, the toner having superior low-temperature fixing properties and capable of forming an image of uniform density.

The inventors of the present invention have conducted studies for solving the aforementioned problems and have found that if a layer of a toner formed through heating under fixation conditions exhibits a light transmittance of 1 to 3% at a wavelength of 690 nm, the toner has superior low-temperature fixing properties and can melt to form a layer having an even thickness on thin and thick portions of a paper sheet and an image of uniform density.

In order to achieve the above object, according to one aspect of the present invention, there is provided a toner for developing an electrostatic image, including a toner particle, wherein the toner particle includes a binder resin and a black colorant, the binder resin including a crystalline resin component, and a toner layer formed through a deposition of the toner on a glass sheet in an amount of 6.5 g/m$^2$ exhibits a light transmittance of 1 to 3% at a wavelength of 690 nm after applying heat at a temperature of 185° C. for five seconds to the toner layer from a position 100 μm away from a surface of the toner layer.

Preferably, in the toner for developing an electrostatic image, the resin contained in the toner particle has a peak top molecular weight of 14,000 to 21,000.

Preferably, in the toner for developing an electrostatic image, the crystalline resin component contained in the toner particle includes a crystalline polyester resin.

Preferably, in the toner for developing an electrostatic image, the crystalline resin component has a melting point of 65° C. to 85° C.

Preferably, in the toner for developing an electrostatic image, the binder resin contained in the toner particle includes a block polymer component.

Preferably, in the toner for developing an electrostatic image, the toner particle includes the block polymer component in an amount of 1 to 20 mass %.

Preferably, in the toner for developing an electrostatic image, the block polymer component has a crystalline segment and an amorphous segment.

Preferably, in the toner for developing an electrostatic image, the crystalline segment has a weight average molecular weight of 1,000 to 3,000, and the amorphous segment has a weight average molecular weight of 10,000 to 40,000.

Preferably, in the toner for developing an electrostatic image, the crystalline segment is a resin segment including a structure derived from a crystalline polyester resin.

Preferably, in the toner for developing an electrostatic image, the toner particle includes a metal that forms ionic crosslinks in the binder resin, and the metal content of the toner particle is 0.05 to 0.25 mass %.

Preferably, in the toner for developing an electrostatic image, the binder resin contained in the toner particle includes a polyester resin component having a structure derived from trimellitic acid.

Preferably, in the toner for developing an electrostatic image, the binder resin contained in the toner particle includes a styrene-acrylic resin component, and the styrene-acrylic resin content of the toner particle is 5 mass % or more.

Preferably, in the toner for developing an electrostatic image, the toner particle is a core particle and forms a core-shell structure with a shell layer coated on the core particle.

Preferably, in the toner for developing an electrostatic image, wherein the shell layer includes a polyester resin having a structure derived from trimellitic acid.

Preferably, in the toner for developing an electrostatic image, the content of the polyester resin having the structure derived from trimellitic acid is 3 to 15 mass % relative to the entire resin contained in the shell layer.

DESCRIPTION OF THE PREFERRED EMBODIMENTS

The toner for developing electrostatic images of the present invention includes a toner particle containing a binder resin and a black colorant, and the binder resin includes a crystalline resin component. A toner layer in an amount of 6.5 g/m$^2$ formed through a deposition of the toner on a glass sheet exhibits a light transmittance of 1 to 3% at a wavelength of 690 nm after applying heat at a temperature of 185° C. for five seconds to the toner layer from a position 100 μm away from a surface of the toner layer. These technical characteristics are common in the claims of the present invention.

In a preferred embodiment of the present invention, the resin contained in the toner particle has a peak top molecular weight of 14,000 to 21,000, the binder resin contains a block polymer component, or the toner particle contains a metal in an amount of 0.05 to 0.25 mass %, the metal forming ionic crosslinks in the binder resin, in view of effective control of the light transmittance to the aforementioned range.

The toner particle is a core particle and forms a core-shell structure composed of the core particle coated with a shell layer. The shell layer preferably contains a polyester resin having a structure derived from trimellitic acid, in view of control of the elastic modulus of only the surface layer of the toner instead of the elastic modulus of the toner as a whole.

The present invention, components thereof, and embodiments for implementing the present invention will now be described in detail.

As used herein, the term "to" between two numerical values indicates that the numeric values before and after the term are inclusive as the lower limit value and the upper limit value, respectively.

[Toner for Developing Electrostatic Images]

The toner for developing an electrostatic image of the present invention includes a toner particle containing a binder resin and a black colorant. The binder resin contains a crystalline resin component.

A toner layer in an amount of 6.5 g/m$^2$ formed through a deposition of the toner for developing an electrostatic image of the present invention on a glass sheet exhibits a light transmittance of 1 to 3% at a wavelength of 690 nm after applying heat at a temperature of 185° C. for five seconds to the toner layer from a position 100 μm away from a surface of the toner layer.

The toner melts through heating to form a thin toner layer, resulting in disappearance of the boundary between toner particles. Thus, a higher light transmittance of the toner layer under the aforementioned heating conditions indicates a higher meltability of the toner.

The adjustment of the light transmittance of the toner layer to 3% or less enables an adjustment of the meltability of the toner such that the melting of the toner at a thick portion of a paper sheet is suppressed, the thick portion coming into contact with a fixing member and receiving large amounts of heat and pressure. This adjustment of the light transmittance can reduce the flow of the toner excessively melted at the thick portion into a thin portion of the paper sheet, leading to no difference in thickness between a toner layer at the thick portion and that at the thin portion, resulting in reduced unevenness of toner image density.

In addition, the adjustment of the light transmittance of the toner layer to 1% or more leads to an adjustment of meltability of the toner at the thin portion of the paper sheet, the thin portion not coming into contact with the fixing unit and receiving small amounts of heat and pressure. This adjustment of the light transmittance can facilitate formation of a layer of the melted toner at the thin portion, resulting in improved low-temperature fixing properties of the toner.

The light transmittance of the toner layer under the aforementioned heating conditions can be adjusted to fall within a range of 1 to 3% by any of the following techniques: control of the molecular weight of the binder resin contained in the toner particle, incorporation of a block polymer component into the toner particle, and adjustment of the degree of ionic crosslinking of the binder resin contained in the toner particle. These techniques may be used in combination.

[Binder Resin]

The binder resin contained in the toner particle may contain any component, such as a block polymer component or an amorphous resin component along with the crystalline resin component. The crystalline resin component exhibits a clear endothermic peak at a melting point (during temperature elevation) in an endothermic curve prepared by differential scanning calorimetry (DSC). The clear endothermic peak has a half width of 15° C. or lower as determined by DSC at a heating rate of 10° C./min. In contrast, the amorphous resin component exhibits no clear endothermic peak at the melting point (during temperature elevation) in the aforementioned endothermic curve.

In view of compatibility between thermal resistance and low-temperature fixing properties, the toner particle preferably has a matrix-domain structure composed of an amorphous resin (matrix) having superior thermal resistance and a crystalline resin (domain) dispersed in the matrix and imparting low-temperature fixing properties to the toner.

The resin contained in the toner particle has a peak top molecular weight (Mp) of preferably 14,000 to 21,000.

The peak top molecular weight (Mp) is a molecular weight corresponding to the maximum of the peak having the maximum area in a molecular weight distribution of the resin determined by gel permeation chromatography (GPC).

A peak top molecular weight (Mp) within the above range leads to adjustment of the meltability of the toner for achieving a light transmittance of the toner layer of 1 to 3% under the aforementioned heating conditions.

The peak top molecular weight (Mp) of the resin can be adjusted by any of the following techniques: appropriate determination of the composition of resin components contained in the binder resin, use of a block polymer described below, and adjustment of the amount of a polymerization initiator or chain transfer agent used for synthesis of the binder resin.

In view of compatibility between superior low-temperature fixing properties and uniform image density, the resin contained in the toner particle has a peak top molecular weight (Mp) of more preferably 15,000 to 19,000, still more preferably 16,000 to 18,000.

The molecular weight distribution of a resin can be determined by GPC as described below.

A sample (toner) is added to tetrahydrofuran (THF) (concentration: 1 mg/mL) and dispersed therein with an ultrasonic disperser at 40° C. for 15 minutes. The dispersion is then filtered through a membrane filter having a pore size of 0.2 μm to prepare a sample solution. The GPC analysis involves the use of a GPC apparatus HLC-8220 (manufactured by Tosoh Corporation) provided with a TSKguard column and three TSKgel SuperHZ-M columns (manufactured by Tosoh Corporation). While the columns are maintained at 40° C., the columns are supplied with tetrahydrofuran (carrier solvent) at a flow rate of 0.2 mL/min. The sample solution (10 μL) and the carrier solvent are injected into the GPC apparatus, and the sample is detected with a refractive index detector (RI detector). The molecular weight distribution of the sample is then calculated from a calibration curve prepared with monodispersed polystyrene standard particles. The calibration curve is prepared with ten polystyrene standard samples (manufactured by Pressure Chemical) having molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$.

[Crystalline Resin Component]

The crystalline resin component contained in the toner particle is preferably a crystalline polyester resin component in view of superior low-temperature fixing properties.

[Crystalline Polyester Resin Component]

The crystalline polyester resin component is derived from any known polyester resin prepared through polycondensation between a di- or more-valent carboxylic acid (polyvalent carboxylic acid) monomer and a di- or more-valent alcohol (polyhydric alcohol) monomer.

The crystalline polyester resin component may be synthesized through any known process. For example, the crystalline polyester resin component can be prepared through polymerization (esterification) between the aforementioned polyvalent carboxylic acid monomer and polyhydric alcohol monomer in the presence of any esterification catalyst.

The polyvalent carboxylic acid monomer is a compound containing two or more carboxy groups per molecule.

Examples of the polyvalent carboxylic acid monomer usable for the synthesis of the crystalline polyester resin component include saturated aliphatic dicarboxylic acids, such as oxalic acid, malonic acid, succinic acid, adipic acid, sebacic acid, azelaic acid, n-dodecylsuccinic acid, and 1,10-decanedicarboxylic acid (dodecanedioic acid); cycloaliphatic dicarboxylic acids, such as cyclohexanedicarboxylic acid; aromatic dicarboxylic acids, such as phthalic acid, isophthalic acid, and terephthalic acid; tri- or more-valent carboxylic acids, such as trimellitic acid and pyromellitic acid; and anhydrides and C1-C3 alkyl esters of these carboxylic acids.

These polyvalent carboxylic acid monomers may be used alone or in combination.

The polyhydric alcohol monomer is a compound containing two or more hydroxy groups per molecule.

Examples of the polyhydric alcohol monomer usable for the synthesis of the crystalline polyester resin component include aliphatic diols, such as 1,2-propanediol, 1,3-propanediol, 1,4-butanediol, 1,5-pentanediol, 1,6-hexanediol, 1,7-heptanediol, 1,8-octanediol, 1,9-nonanediol, neopentyl glycol, and 1,4-butenediol; and tri- or higher-valent alcohols, such as glycerol, pentaerythritol, trimethylolpropane, and sorbitol.

These polyhydric alcohol monomers may be used alone or in combination.

Examples of the usable esterification catalyst include compounds of alkali metals, such as sodium and lithium; compounds of alkaline earth metals, such as magnesium and calcium; compounds of metals, such as aluminum, zinc, manganese, antimony, titanium, tin, zirconium, and germanium; phosphite compounds; phosphate compounds; and amine compounds.

The polymerization may be performed at any temperature. The polymerization temperature is preferably 150 to 250° C. The polymerization may be performed for any period of time. The polymerization time is preferably 0.5 to 10 hours. The polymerization may optionally be performed in a reaction system under reduced pressure.

The crystalline resin component (e.g., crystalline polyester resin component) has a melting point (Tm) of preferably 65 to 85° C., more preferably 70 to 80° C., in view of superior low-temperature fixing properties, thermal resistance, and hot offset resistance of the toner.

The melting point (Tm), which corresponds to the peak top temperature at the peak of an endothermic curve, can be measured by DSC.

In detail, a sample is sealed in an aluminum pan (KITNO. B0143013) and is placed on a sample holder of a thermal analyzer Diamond DSC (manufactured by PerkinElmer Inc.). The temperature of the sample is controlled through sequential processes of heating, cooling, and heating. In the first and second heating processes, the sample is heated from room temperature (25° C.) (first heating process) and from 0° C. (second heating process), respectively, to 150° C. at a rate of 10° C./min and maintained at 150° C. for five minutes. In the cooling process, the sample is cooled from 150° C. to 0° C. at a rate of 10° C./min and maintained at 0° C. for five minutes. The melting point (Tm) corresponds to the peak top temperature at the peak of an endothermic curve obtained through the second heating process.

The amount of the crystalline resin component (e.g., crystalline polyester resin component) contained in the toner particle is preferably 5 to 20 mass %, more preferably 7 to 15 mass %, in view of superior low-temperature fixing properties, thermal resistance, and hot offset resistance of the toner.

[Block Polymer Component]

The binder resin contained in the toner particle preferably contains a block polymer component. The block polymer component is composed of two or more resins.

The adjustment of the molecular weight or content of the block polymer component can control the meltability of the toner such that a layer of the toner exhibits a light transmittance of 1 to 3% under the aforementioned heating conditions.

The block polymer content of the toner particle is preferably 1 to 20 mass %, more preferably 5 to 20 mass %, still more preferably 5 to 15 mass %.

A block polymer content of 1 mass % or more leads to a reduction in excess melting of the toner only by heating during fixation, whereas a block polymer content of 20 mass % or less leads to melting of the toner under application of small amounts of heat and pressure during fixation. Such control of the meltability achieves a toner having superior low-temperature fixing properties and capable of forming an image of uniform density.

The block polymer component preferably has a crystalline segment and an amorphous segment.

The crystalline segment has a structure derived from a crystalline resin, and the amorphous segment has a structure derived from an amorphous resin.

The crystalline segment can reduce the meltability of the toner, and the amorphous segment can increase the meltability of the toner. Thus, these segments facilitate control of the meltability of the toner. The block polymer component, which exhibits a microscopic phase separation, can provide the toner with pressure dependence of the melting and spreading of the toner under application of pressure during fixation.

The crystalline segment of the block polymer component may be composed of any of the aforementioned crystalline resins. The crystalline segment preferably has a structure derived from a crystalline polyester resin used for the binder resin contained in the toner particle. In such a case, the block polymer component exhibits high compatibility with the crystalline polyester resin component contained in the binder resin, and thus the block polymer further facilitates control of the meltability of the toner.

The resin used for formation of the crystalline segment has a melting point (Tm) of preferably 65 to 85° C.

The crystalline segment has a weight average molecular weight (Mw) of preferably 1,000 to 3,000.

A weight average molecular weight (Mw) within the above range leads to high crystallinity, resulting in control of low meltability of the toner and an improvement in low-temperature fixing properties of the toner.

The weight average molecular weight (Mw) and number average molecular weight (Mn) of the resin can be calculated on the basis of the molecular weight distribution of the resin determined by the aforementioned GPC analysis.

The amorphous segment of the block polymer component may be composed of a vinyl resin (e.g., a polystyrene, styrene-butadiene, or styrene-acrylic resin) or an amorphous resin (e.g., an amorphous polyester resin). Such a resin may be modified with a urethane, urea, or epoxy resin.

The amorphous segment preferably has a structure derived from an amorphous resin used for the binder resin contained in the toner particle. In such a case, the block polymer component exhibits high compatibility with the binder resin, resulting in improved dispersibility of the block polymer in the binder resin.

The resin used for formation of the amorphous segment has a glass transition point (Tg) of preferably 40 to 75° C.

The glass transition point (Tg) of the resin can be determined in accordance with the method (DSC method) specified in American Society for Testing and Materials (ASTM) standard D3418-82. The glass transition point (Tg) can be determined with, for example, a differential scanning calorimeter DSC-7 (manufactured by PerkinElmer Inc.) or a thermal analysis controller TACT/DX (manufactured by PerkinElmer Inc.).

The amorphous segment has a weight average molecular weight (Mw) of preferably 10,000 to 40,000.

A weight average molecular weight (Mw) within the above range leads to an increase in meltability of the toner and improved robustness of the toner, resulting in reduced filming of the toner on a photoreceptor.

[Amorphous Resin Component]

The amorphous resin component may be composed of, for example, a vinyl resin or an amorphous polyester resin. The vinyl resin is prepared through polymerization of a vinyl monomer. Examples of the vinyl resin include styrene, acrylic, and styrene-acrylic resins.

The binder resin contained in the toner particle preferably contains a styrene-acrylic resin, and the styrene-acrylic resin content of the toner particle is preferably 5 mass % or more, in view of superior thermal resistance during storage of the toner.

The styrene-acrylic resin content of the toner particle is preferably 80 mass % or less in view of compatibility between low-temperature fixing properties and thermal resistance during storage of the toner.

The vinyl monomer is a polymerizable monomer having a vinyl group. Vinyl monomers may be used alone or in combination. Examples of the vinyl monomer will be described below. A polymer having a crosslinked structure can be prepared from a polyfunctional vinyl compound. The styrene-acrylic resin may be a copolymer composed of a styrene monomer, a (meth)acrylic acid monomer, and any other vinyl monomer.

(1) Styrene Monomers

Monomers having a styrene structure, such as styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, p-n-dodecylstyrene, and derivatives thereof.

(2) (Meth)Acrylic Acid Monomers

Monomers having a (meth)acryl group, such as (meth) acrylic acid, methyl (meth)acrylate, ethyl (meth)acrylate, n-butyl (meth)acrylate, isopropyl (meth)acrylate, isobutyl (meth)acrylate, t-butyl (meth) acrylate, n-octyl (meth) acrylate, 2-ethylhexyl (meth)acrylate, stearyl (meth)acrylate, lauryl (meth)acrylate, phenyl (meth) acrylate, diethylaminoethyl (meth) acrylate, dimethylaminoethyl (meth)acrylate, and derivatives thereof.

(3) Vinyl Esters

Vinyl propionate, vinyl acetate, and vinyl benzoate, etc.

(4) Vinyl Ethers

Vinyl methyl ether and vinyl ethyl ether, etc.

(5) Vinyl Ketones

Vinyl methyl ketone, vinyl ethyl ketone, and vinyl hexyl ketone, etc.

(6) N-Vinyl Compounds

N-vinylcarbazole, N-vinylindole, and N-vinylpyrrolidone, etc.

(7) Other Compounds

Vinyl compounds, such as vinylnaphthalene and vinylpyridine, and derivatives of acrylic acid and methacrylic acid, such as acrylonitrile, methacrylonitrile, and acrylamide.

(8) Polyfunctional Vinyl Compounds

Divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol dimethacrylate, and neopentyl glycol diacrylate.

Particularly preferred is a vinyl resin composed of a vinyl monomer having an acid group because ionic crosslinks are readily formed between molecules of the vinyl resin, and the degree of ionic crosslinking is readily controlled through adjustment of the number of acid groups contained in the vinyl resin.

As used herein, the term "acid group" refers to an ionic dissociable group, such as a carboxy, sulfonate, or phosphate group.

Examples of the vinyl monomer having a carboxy group include acrylic acid, methacrylic acid, maleic acid, itaconic acid, cinnamic acid, fumaric acid, monoalkyl maleate, and monoalkyl itaconate.

Examples of the vinyl monomer having a sulfonate group include styrenesulfonic acid, allylsulfosuccinic acid, and 2-acrylamido-2-methylpropanesulfonic acid.

Examples of the vinyl monomer having a phosphate group include acidophosphooxyethyl methacrylate.

The vinyl resin has a glass transition point (Tg) of preferably 20 to 70° C. in view of compatibility between low-temperature fixing properties and thermal resistance during storage of the toner.

The vinyl resin content of the toner particle is preferably 5 mass % or more, more preferably 20 to 60 mass %, still more preferably 35 to 60 mass %, in view of achievement of superior thermal resistance.

[Amorphous Polyester Resin]

The amorphous polyester resin is derived from any polyester resin prepared through polymerization between a polyvalent carboxylic acid monomer and a polyhydric alcohol monomer.

As in the aforementioned crystalline polyester resin, the amorphous polyester resin can be prepared through polymerization between a polyvalent carboxylic acid monomer and a polyhydric alcohol monomer in the presence of an esterification catalyst.

Examples of the polyvalent carboxylic acid monomer usable for the synthesis of the amorphous polyester resin include phthalic acid, isophthalic acid, terephthalic acid, trimellitic acid, naphthalene-2,6-dicarboxylic acid, malonic acid, mesakonin acid, dimethyl isophthalate, fumaric acid, dodecenylsuccinic acid, and 1,10-decanedicarboxylic acid. Of these, preferred are dimethyl isophthalate, terephthalic acid, dodecenylsuccinic acid, and trimellitic acid.

Examples of the polyhydric alcohol monomer usable for the synthesis of the amorphous polyester resin include divalent and trivalent alcohols, such as ethylene glycol, propylene glycol, 1,4-butanediol, 2,3-butanediol, diethylene glycol, triethylene glycol, 1,5-pentanediol, 1,6-hexanediol, neopentyl glycol, 1,4-cyclohexanedimethanol, dipropylene glycol, poly(ethylene glycol), poly(propylene glycol), bisphenol A-ethylene oxide adduct (BPA-EO), bisphenol A-propylene oxide adduct (BPA-PO), glycerol, sorbitol, and 1,4-sorbitan, and trimethylolpropane. Of these, preferred are bisphenol A-ethylene oxide adduct and bisphenol A-propylene oxide adduct.

The amorphous polyester resin preferably has a structure derived from trimellitic acid.

A large number of ionic crosslinks can be formed in such an amorphous polyester resin. An increase in number of ionic crosslinks leads to a reduction in meltability of the toner. Thus, the meltability of the toner can be readily controlled through adjustment of the degree of ionic crosslinking.

[Metal]

The toner particle contains a metal that forms ionic crosslinks in the binder resin. The metal content of the toner particle is preferably 0.05 to 0.25 mass %, more preferably 0.05 to 0.20 mass %, still more preferably 0.05 to 0.15 mass %.

The incorporation of the metal within the above range can control the meltability of the toner such that a layer of the toner exhibits a light transmittance of 1 to 3% under the aforementioned heating conditions.

The toner particle contains a metal derived from a flocculant used for preparation of the toner and a metal derived from an esterification catalyst used for synthesis of the polyester resin. The metal derived from the flocculant forms ionic crosslinks in the binder resin.

The content of the metal derived from the flocculant indicates the degree of ionic crosslinking in the binder resin. An increase in metal content leads to an increase in degree of ionic crosslinking, resulting in a reduction in meltability of the toner. Thus, the adjustment of the metal content can control the meltability of the toner during heating.

The metal content of the toner particle can be determined by acid digestion and inductively coupled plasma-optical emission spectrometry (ICP-OES) as described below.

A toner (3 parts by mass) is dispersed in 0.2 mass % aqueous polyoxyethylene phenyl ether solution (35 parts by mass). The dispersion is treated with an ultrasonic homogenizer US-1200T (manufactured by NIHONSEIKI KAISHA LTD.) at 25° C. for five minutes to remove an external additive from the toner surface, to prepare a sample for analysis.

The sample (100 mg) is placed in a closed microwave digester ETHOS 1 (manufactured by Milestone General K.K.) and then decomposed with sulfuric acid and nitric acid. Undecomposed residue is treated with, for example, hydrochloric acid, hydrofluoric acid, and hydrogen peroxide for elution of target components. The sample mixture is appropriately diluted with ultrapure water. This analysis involves the use of ultrapure reagents manufactured by Kanto Chemical Co., Inc.

The pretreated sample mixture is placed in an inductively coupled plasma emission spectrometer SPS3520UV (SII NanoTechnology Inc.), to determine the content of a target metal contributing to formation of ionic crosslinks in the binder resin. The target metal is detected at the wavelength of the metal.

A calibration curve is prepared by use of a sample-free solution containing a metal standard solution for atomic absorption analysis (manufactured by Kanto Chemical Co., Inc.) and having the same acid concentration as the sample mixture.

[Colorant]

The black colorant may be of any known type, such as carbon black (e.g., furnace black or channel black), a magnetic material (e.g., magnetite or ferrite), a dye, or an inorganic pigment (e.g., non-magnetic iron oxide).

The black colorant may be used in combination with any other colorant.

The black colorant may be used in combination with one or more known dyes or organic pigments. Examples of the organic pigments include C. I. Pigment Reds 5, 48:1, 53:1, 57:1, 81:4, 122, 139, 144, 149, 166, 177, 178, 222, 238, and 269, C. I. Pigment Yellows 14, 17, 74, 93, 94, 138, 155, 180, and 185, C. I. Pigment Oranges 31 and 43, and C. I. Pigment Blues 15:3, 60, and 76. Examples of the dyes include C. I. Solvent Reds 1, 49, 52, 58, 68, 11, and 122, C. I. Solvent Yellows 19, 44, 77, 79, 81, 82, 93, 98, 103, 104, 112, and 162, and C. I. Solvent Blues 25, 36, 69, 70, 93, and 95.

The content of the colorant is 1 to 10 parts by mass, preferably 2 to 8 parts by mass, relative to 100 parts by mass of the binder resin.

The toner particle may optionally contain any additive, such as a release agent or a charge controlling agent.

[Release Agent]

The toner may contain any known release agent (wax). Examples of the usable release agent include polyolefin waxes, such as polyethylene wax and polypropylene wax; branched-chain hydrocarbon waxes, such as microcrystalline wax; long-chain hydrocarbon waxes, such as paraffin wax and Sasolwax; dialkyl ketone waxes, such as distearyl ketone; ester waxes, such as carnauba wax, montan wax, behenyl behenate, trimethylolpropane tribehenate, pentaerythritol tetrabehenate, pentaerythritol diacetate dibehenate, glycerin tribehenate, 1,18-octadecanediol distearate, tristearyl trimellitate, and distearyl maleate; and amide waxes, such as ethylenediaminebehenylamide and trimellitic acid tristearylamide.

The release agent content of the toner particle is preferably 3 to 15 parts by mass in view of achievement of sufficient fixing and releasing properties.

[Charge Controlling Agent]

The charge controlling agent may be any known compound. Examples of such a compound include nigrosine dyes, metal salts of naphthenic acid and higher fatty acids, alkoxylated amines, quaternary ammonium salts, azo-metal complexes, and salicylic acid metal salts. The charge controlling agent can provide the toner with superior charging characteristics.

The content of the charge controlling agent is typically 0.1 to 5.0 parts by mass relative to 100 parts by mass of the binder resin.

[Core-Shell Structure]

The toner particle may be used as is. Alternatively, the toner particle may be a core particle and has a core-shell structure with a shell layer coated on the core particle.

The core particle may be partially coated with the shell layer; i.e., the core particle may be partially exposed to the outside. A cross section of the core-shell structure can be observed with any known device, such as a transmission electron microscope (TEM) or a scanning probe microscope (SPM).

In the case of the core-shell structure, the core particle and the shell layer may have different physical properties, such as glass transition point, melting point, and elastic modulus. Thus, the toner particle can be designed for the intended use thereof. For example, a core particle containing a binder resin, a colorant, and a release agent and having a relatively low glass transition point (Tg) can be coated with a shell layer composed of a fused resin having a relatively high glass transition point (Tg).

In the core-shell structure, the shell layer preferably contains a polyester resin having a structure derived from trimellitic acid.

This configuration can increase the degree of ionic cross-linking in the surface layer of the toner particle, leading to an increase in the elastic modulus of only the surface layer of the toner without changing the elastic modulus of the toner as a whole. Thus, the meltability of the toner can be readily controlled such that the toner hardly melts at a thick portion of a paper sheet (which portion comes into contact with a fixing member) and readily melts at a thin portion of the paper sheet (which portion does not come into contact with the fixing member).

The content of the polyester resin having a structure derived from trimellitic acid is preferably 3 to 15 mass %, more preferably 5 to 10 mass %, relative to the entire resin contained in the shell layer.

A polyester resin content within the above range results in a toner that hardly melts at a thick portion of a paper sheet (which portion comes into contact with a fixing member) and readily melts at a thin portion of the paper sheet (which portion does not come into contact with the fixing member).

[External Additive]

The toner particle may be used without incorporation of any additive. Alternatively, the toner particle may contain any external additive (e.g., a fluidizer or a cleaning aid) in view of improvements in fluidity, charging properties, and cleanability. Such an external additive may be added to the surface of the toner particle.

Examples of the external additive include fine inorganic oxide particles, such as fine particles of silica, alumina, and titanium oxide; fine inorganic stearate compound particles, such as fine particles of aluminum stearate and zinc stearate; and fine particles of inorganic titanate compounds, such as strontium titanate and zinc titanate. These external additives may be used alone or in combination.

Such inorganic particles are preferably subjected to gloss treatment with, for example, a silane coupling agent, a titanium coupling agent, a higher fatty acid, or silicone oil in view of thermal resistance during storage and environmental stability of the toner.

The amount of the external additive (or the total amount of two or more external additives) is preferably 0.05 to 5 parts by mass, more preferably 0.1 to 3 parts by mass, relative to 100 parts by mass of the toner.

[Developer]

The toner for developing an electrostatic image of the present invention may be used as a magnetic or non-magnetic one-component developer. Alternatively, the toner may be mixed with a carrier and used as a two-component developer.

The carrier for forming the two-component developer may be magnetic particles composed of any known material, such as a metal material (e.g., iron, ferrite, or magnetite) or an alloy of such a metal and aluminum or lead. Ferrite particles are particularly preferred.

The carrier may be composed of magnetic particles covered with a coating agent (e.g., resin), or may be in the form of a dispersion of fine magnetic particles in a binder resin.

The carrier has a volume median particle size of preferably 20 to 100 μm, more preferably 25 to 80 μm.

The volume median particle size of the carrier can be measured with, for example, a laser diffraction particle size analyzer HELOS (manufactured by SYMPATEC) equipped with a wet disperser.

[Production of Toner for Developing an Electrostatic Image]

The toner for developing an electrostatic image of the present invention can be produced by any known process, such as suspension polymerization or emulsion aggregation. In view of production cost and production stability, an emulsion aggregation process is preferred which can readily form toner particles of small size.

The emulsion aggregation process involves mixing of an aqueous dispersion of binder resin particles with an aqueous dispersion of black colorant particles, and aggregation of the binder resin particles and the colorant particles, to prepare toner particles.

The aqueous dispersion is composed of particles dispersed in an aqueous medium. As used herein, the term "aqueous medium" refers to a medium containing water in an amount of 50 mass % or more.

Examples of the component of the aqueous medium other than water include organic solvents miscible with water, such as methanol, ethanol, 2-propanol, butanol, acetone, methyl ethyl ketone, and tetrahydrofuran. Among these compounds, preferred are organic alcohol solvents, such as methanol, ethanol, 2-propanol, and butanol, which cannot dissolve the resin.

A process for producing the toner through emulsion aggregation will now be described.

(Step (1))

Step (1) involves preparation of a dispersion of particles of a binder resin containing a crystalline resin component, a block polymer component, and/or an amorphous resin component.

In use of a crystalline polyester resin component as the crystalline resin component, the crystalline polyester resin is synthesized and dissolved or dispersed in an organic solvent to prepare an oil-phase solution, and the oil-phase solution is subjected to phase inversion emulsification, to disperse polyester resin particles in an aqueous medium. After formation of oil droplets having a desired size, the organic solvent is removed to prepare an aqueous polyester resin dispersion.

The organic solvent used for preparation of the oil-phase solution is an organic solvent having a low boiling point and low solubility in water in view of easy removal of the solvent after formation of oil droplets. Examples of the organic solvent include methyl acetate, ethyl acetate, methyl ethyl ketone, methyl isobutyl ketone, toluene, and xylene. These organic solvents may be used alone or in combination.

The amount of an organic solvent is typically 1 to 300 parts by mass relative to 100 parts by mass of the crystalline polyester resin.

The oil-phase solution can be emulsified by use of mechanical energy.

The amount of the aqueous medium is preferably 50 to 2,000 parts by mass, more preferably 100 to 1,000 parts by mass, relative to 100 parts by mass of the oil-phase solution.

The aqueous medium may contain a surfactant for improving the dispersion stability of oil droplets.

The crystalline polyester resin particles have a volume median particle size (D50) of preferably 100 to 400 nm.

The volume median particle size (D50) of the crystalline polyester resin particles can be determined with a particle size analyzer Microtrac UPA-150 (manufactured by NIKKISO CO., LTD.).

The block polymer can be prepared through reaction between terminal functional groups of a plurality of resins serving as crystalline and amorphous segments, or through reaction between the resins in the presence of a binder. Examples of the binder include polyvalent carboxylic acids, polyhydric alcohols, polyvalent isocyanates, polyfunctional epoxy compounds, and acid anhydrides.

For example, the block copolymer may be prepared through condensation between polyester resins (in the absence of a binder) with heating under reduced pressure. Alternatively, the block polymer may be synthesized through reaction between resins (other than polyester resins) having terminal functional groups (carboxy and hydroxy groups) in the same manner as described above.

In use of a vinyl resin as the binder resin, an aqueous dispersion of vinyl resin particles can be prepared by a miniemulsion polymerization process. In detail, a vinyl monomer and a water-soluble radical polymerization initiator are added to an aqueous medium containing a surfactant, and mechanical energy is applied to the resultant mixture to form droplets. Radicals generated from the initiator promote polymerization reaction in the droplets. The droplets may contain an oil-soluble polymerization initiator.

The vinyl resin particles may have a multilayer structure including two or more layers having different compositions. A dispersion of vinyl resin particles having a multilayer structure can be prepared through multistep polymerization reaction. For example, a dispersion of vinyl resin particles having a two-layer structure can be prepared by a process involving polymerization of a vinyl monomer (first polymerization step) to prepare a dispersion of vinyl resin particles, and the subsequent polymerization (second polymerization step) after addition of a polymerization initiator and another vinyl monomer.

(Surfactant)

Examples of the surfactant usable in the dispersion include cationic surfactants, such as dodecylammonium bromide and dodecyltrimethylammonium bromide; anionic surfactants, such as dodecyl polyoxyethylene ether, hexadecyl polyoxyethylene ether, nonylphenyl polyoxyethylene ether, lauryl polyoxyethylene ether, and sorbitan monooleate polyoxyethylene ether; and nonionic surfactants, such as sodium stearate, sodium laurate, sodium lauryl sulfate, sodium dodecylbenzenesulfonate, and sodium dodecyl sulfate.

(Polymerization Initiator)

The polymerization initiator may be of any known type. Preferred examples of the polymerization initiator include persulfates, such as potassium persulfate and ammonium persulfate. Other examples include azo compounds, such as 4,4'-azobis(4-cyanovaleric acid) and salts thereof and 2,2'-azobis(2-amidinopropane) salts; peroxide compounds; and azobisisobutyronitrile.

(Chain Transfer Agent)

The aqueous medium may contain a common chain transfer agent for controlling the molecular weight of the vinyl resin. The chain transfer agent may be of any type. Examples of the chain transfer agent include 2-chloroethanol; mercaptans, such as octyl mercaptan, dodecyl mercaptan, t-dodecyl mercaptan, and n-octyl 3-mercaptopropionate; and styrene dimers.

For production of toner particles containing an additive (e.g., a release agent or a charge controlling agent), the additive is preliminarily dissolved or dispersed in a solution of the vinyl monomer.

As described above, the additive is preferably introduced into the toner particles by a process involving preliminary dispersion of the additive in vinyl resin particles. Alternatively, the additive may be introduced into the toner particles by a process involving preparation of a dispersion of additive particles separately from the vinyl resin solution, mixing of the dispersion with a dispersion of polyester resin particles, and aggregation of the polyester resin particles and the additive particles.

The vinyl resin particles in the dispersion have a volume median particle size (D50) of preferably 100 to 400 nm.

The volume median particle size (D50) of the vinyl resin particles can be determined with a particle size analyzer Microtrac UPA-150 (manufactured by NIKKISO CO., LTD.).

(Step (2))

Step (2) involves preparation of an aqueous dispersion of colorant particles through dispersion of a black colorant in the form of fine particles in an aqueous medium.

The aqueous colorant particle dispersion can be prepared through dispersion of the colorant in an aqueous medium containing a surfactant at a critical micelle concentration (CMC) or higher.

The colorant can be dispersed by use of mechanical energy with any disperser. Preferred examples of the disperser include ultrasonic dispersers, mechanical homogenizers, pressure dispersers (e.g., a Manton Gaulin homogenizer and a pressure homogenizer), and media dispersers (e.g., a sand grinder, a Getzmann mill, and a diamond fine mill).

The colorant particles in the aqueous dispersion have a volume median particle size (D50) of preferably 10 to 300 nm, more preferably 100 to 200 nm, particularly preferably 100 to 150 nm.

The volume median particle size (D50) of the colorant particles can be determined with an electrophoretic light scattering photometer ELS-800 (manufactured by Otsuka Electronics Co., Ltd.).

(Step (3))

Step (3) involves preparation of toner particles through aggregation of binder resin particles (e.g., vinyl resin particles and polyester resin particles), colorant particles, and other toner-forming particles in the presence of a flocculant.

In detail, an aqueous medium is mixed with aqueous dispersions of these types of particles, a flocculant is added to the mixture at a critical aggregation concentration or higher, and the resultant mixture is heated to a temperature equal to or higher than the glass transition point (Tg) of the vinyl resin for aggregation of the particles.

(Flocculant)

The flocculant may be of any type, and is preferably a metal salt, such as an alkali metal salt or an alkaline earth metal salt. Examples of the metal salt include salts of monovalent metals, such as sodium, potassium, and lithium; salts of divalent metals, such as calcium, magnesium, manganese, and copper; and salts of trivalent metals, such as iron and aluminum. Specific examples of the metal salts include sodium chloride, potassium chloride, lithium chloride, calcium chloride, magnesium chloride, zinc chloride, copper sulfate, magnesium sulfate, and manganese sulfate. Among these, divalent metal salts are particularly preferred. The use of a small amount of such a divalent metal salt can promote aggregation. These flocculants may be used alone or in combination.

(Step (4))

Step (4) involves aging of the toner particles prepared in step (3) to control the particles into a desired shape. Step (4) may optionally be performed.

In detail, the toner particle dispersion prepared in step (3) is heated with agitation. The heating temperature, the agitation rate, and the heating time are adjusted to achieve a desired roundness of the toner particles.

(Step (4B))

Step (4B) involves formation of a shell layer that covers at least a portion of the surface of a core particle (i.e., the toner particle prepared in step (3) or (4)). Step (4B) may optionally be performed for formation of toner particles having a core-shell structure.

For preparation of toner particles having a core-shell structure, a rein for forming a shell layer is dispersed in an aqueous medium to prepare a dispersion of resin particles for shell layer, the dispersion is added to the toner particle dispersion prepared in step (3) or (4), and the resin particles for shell layer are aggregated and fused with toner particles. A dispersion of toner particles having a core-shell structure is thereby prepared.

The shell-forming step may be followed by heating of the reaction system for strong fusion of the core particles with the resin particles for shell layer. This heating may be continued until the toner particles exhibit an intended roundness.

(Step (5))

Step (5) involves cooling of the toner particle dispersion to separate the toner particles from the dispersion. The resultant toner cake (wet caked agglomeration of toner particles) is washed for removal of deposits (e.g., surfactants or flocculants), followed by drying of the washed toner.

(Step (6))

Step (6) involves addition of an external additive to the toner particles. Step (6) may optionally be performed.

The external additive may be added to the toner particles with a mechanical mixer, such as a Henschel mixer or a coffee mill.

EXAMPLES

The present invention will now be described in detail by way of examples, which should not be construed to limit the present invention. In the following examples, the term "parts" and the symbol "%" refer to "parts by mass" and "mass %," respectively, unless otherwise specified.

In Examples, the weight average molecular weight (Mw) and number average molecular weight (Mn) of a resin were calculated on the basis of the molecular weight distribution of the resin determined by the following GPC analysis.

A sample (toner) was added to tetrahydrofuran (THF) (concentration: 1 mg/mL) and dispersed therein with an ultrasonic disperser at 40° C. for 15 minutes. The dispersion was then filtered through a membrane filter having a pore size of 0.2 μm to prepare a sample solution. The GPC analysis involved the use of a GPC apparatus HLC-8220 (manufactured by Tosoh Corporation) provided with a TSKguard column and three TSKgel SuperHZ-M columns (manufactured by Tosoh Corporation). While the columns were maintained at 40° C., the columns were supplied with tetrahydrofuran (carrier solvent) at a flow rate of 0.2 mL/min. The sample solution (10 μL) and the carrier solvent were injected into the GPC apparatus, and the sample was detected with a refractive index detector (RI detector). The molecular weight distribution of the sample was then calculated from a calibration curve prepared with monodispersed polystyrene standard particles. The calibration curve was prepared with ten polystyrene standard samples (manufactured by Pressure Chemical) having molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$.

The melting point (Tm) or glass transition point (Tg) of a resin was determined on the basis of an endothermic curve obtained through the DSC analysis as described below.

A sample (resin) was sealed in an aluminum pan and placed on a holder. An empty aluminum pan was used as a reference. The temperature of the sample was controlled through sequential processes of heating, cooling, and heating (temperature range: 0 to 200° C., heating rate: 10° C./minute, cooling rate: 10° C./minute). The melting point was determined on the basis of the data obtained through the second heating process; i.e., the melting point was the temperature at the peak top of the peak of the endothermic curve. The glass transition point was the intersection of a line extending from the base line of the first endothermic peak and a tangent corresponding to the maximum slope between the rising point and maximum point of the first endothermic peak.

The softening point (Tsp) of a resin was determined as described below.

A sample (1.1 g) was uniformly applied onto a petri dish and then allowed to stand for 12 hours or more at 20° C. and 50% RH. Subsequently a pressure of 3,820 kg/cm$^2$ was applied to the sample with a press SSP-10A (manufactured by Shimadzu Corporation) for 30 seconds, to prepare a cylindrical compacted sample having a diameter of 1 cm. The compacted sample was subjected to analysis with a flow tester CFT-500D (manufactured by Shimadzu Corporation) under the following conditions: a load of 196 N (20 kgf), an initial temperature of 60° C., a preheating time of 300 seconds, and a heating rate of 6° C./minute. After completion of the preheating, the sample was extruded through a cylindrical die hole (1 mm in diameter by 1 mm) with a piston having a diameter of 1 cm. The offset temperature (Toffset) of the sample was determined by the aforementioned process for measurement of the melting temperature at an offset value of 5 mm. The offset temperature was defined as the softening point (° C.).

[Styrene-Acrylic Resin Particle Dispersion]

(First Polymerization Step)

Sodium lauryl sulfate (i.e., an anionic surfactant) (2.0 parts by mass) was dissolved in deionized water (2,900 parts by mass) to prepare a surfactant solution. The surfactant solution was placed into a reactor equipped with an agitator, a temperature sensor, a temperature controller, a cooling tube, and a nitrogen feeder, and the solution was agitated at 230 rpm under a nitrogen gas stream while the internal temperature was raised to 80° C.

Potassium persulfate (KPS) (i.e., a polymerization initiator) (9.0 parts by mass) was added to the surfactant solution, and the internal temperature was adjusted to 78° C. The following mixture of monomers was added dropwise to the reactor over three hours. After dropwise addition, the resultant mixture was heated with agitation at 78° C. for one hour for polymerization (first polymerization step), to prepare styrene-acrylic resin particle dispersion (I):

styrene, 540 parts by mass;
n-butyl acrylate, 270 parts by mass;
methacrylic acid, 65 parts by mass; and
n-octyl mercaptan, 17 parts by mass.

(Second Polymerization Step)

An ester wax (i.e., a release agent) having a melting point of 73° C. (51 parts by mass) was added to the following mixture of monomers in a flask equipped with an agitator, and the wax was dissolved in the mixture at 85° C., to prepare a wax solution:

styrene, 94 parts by mass;
n-butyl acrylate, 30 parts by mass;
2-ethylhexyl acrylate, 30 parts by mass;
methacrylic acid, 11 parts by mass; and
n-octyl mercaptan, 5 parts by mass.

Sodium lauryl sulfate (i.e., an anionic surfactant) (2 parts by mass) was dissolved in deionized water (1,100 parts by mass), and the surfactant solution was heated to 90° C. Styrene-acrylic resin particle dispersion (I) (28 parts by mass in terms of solid content) was added to the surfactant solution. The resultant mixture was then mixed with the aforementioned wax solution for one hour with a mechanical disperser "CLEARMIX" having a circulation path (manufactured by M Technique Co., Ltd.), to prepare a dispersion containing emulsified particles having a particle size of 350 nm. The dispersion was mixed with an aqueous solution of potassium persulfate (KPS) (i.e., a polymerization initiator) (2.5 parts by mass) in deionized water (110 parts by mass), and the mixture was heated with agitation at 90° C. for two hours for polymerization (second polymerization step), to prepare styrene-acrylic resin particle dispersion (II).

Styrene-acrylic resin particle dispersion (II) was mixed with an aqueous solution of potassium persulfate (KPS) (i.e., a polymerization initiator) (2.5 parts by mass) in deionized water (110 parts by mass). The following mixture of monomers was added dropwise to the initiator-containing mixture over one hour at 80° C. After dropwise addition, the resultant mixture was heated with agitation for three hours for polymerization (third polymerization step):

styrene, 230 parts by mass;
n-butyl acrylate, 100 parts by mass;
methacrylic acid, 18 parts by mass; and
n-octyl mercaptan, 5 parts by mass.

The resultant mixture was cooled to 28° C. to prepare a styrene-acrylic resin particle dispersion.

The styrene-acrylic resin contained in the dispersion had a weight average molecular weight (Mw) of 30,300 and a number average molecular weight (Mn) of 10,100.

[Crystalline Polyester Resin Particle Dispersion]

Sebacic acid (i.e., a polyvalent carboxylic acid) (300 parts by mass) and 1,6-hexanediol (i.e., a polyhydric alcohol) (170 parts by mass) were placed in a 5-L reactor equipped with an agitator, a temperature sensor, a cooling tube, and a nitrogen feeder, and the mixture was agitated while the internal temperature was raised to 190° C. over one hour. After determination of homogeneous agitation of the mixture, a catalyst $Ti(OBu)_4$ was added to the mixture in an amount of 0.003 mass % relative to the amount of the polyvalent carboxylic acid. While generated water was removed through evaporation, the internal temperature was raised from 190° C. to 240° C. over six hours. The dehydration-condensation reaction was continued at 240° C. for six hours for polymerization, to prepare a crystalline polyester resin. The crystalline polyester resin had a melting point (Tm) of 66.8° C. and a number average molecular weight (Mn) of 6,300.

The crystalline polyester resin (300 parts by mass) and methyl ethyl ketone (solvent) (160 parts by mass), and isopropyl alcohol (solvent) (100 parts by mass) were placed in a 3-L jacketed reactor (BJ-30N, manufactured by TOKYO RIKAKIKAI CO., LTD.) equipped with a condenser, a thermometer, a water dropper, and an anchor blade. The reactor was placed in a water-circulating thermostatic bath at 70° C., and the resin was dissolved in the solvents with agitation at 100 rpm.

The agitation rate was then adjusted to 150 rpm, and the water-circulating thermostatic bath was maintained at 66° C. Subsequently, 10 mass % aqueous ammonia (reagent) (17 parts by mass) was added to the mixture over 10 minutes, and deionized water maintained at 66° C. (900 parts by mass in total) was added dropwise to the mixture at a rate of 7 parts by mass/minute for phase inversion, to prepare an emulsion.

Immediately thereafter, the resultant emulsion (800 parts by mass) and deionized water (700 parts by mass) were placed in a 2-L recovery flask, and the flask was attached via a trap ball to an evaporator (manufactured by TOKYO RIKAKIKAI CO., LTD.) equipped with a vacuum controlling unit. While being rotated, the recovery flask was heated in a hot water bath at 60° C. and evacuated to 7 kPa with careful attention to bumping, to remove the solvent. After the recovery of the solvent in an amount of 1,100 parts by mass, the recovery flask was returned to ambient pressure and cooled with water, to yield a dispersion. The dispersion had no odor of solvent. The resin particles contained in the dispersion had a volume median particle size (D50) of 130 nm. Deionized water was then added to the dispersion for adjustment of the solid content to 20 mass %, to prepare a crystalline polyester resin dispersion.

[Block Polymer Particle Dispersion]

Dodecanedioic acid (173 parts), 1,10-decanediol (174 parts), and dibutyltin oxide (0.08 parts) were placed in a flask purged with nitrogen, and these monomers were reacted at 170° C. for two hours and then at 200° C. for 0.5 hours under reduced pressure, to prepare a crystalline resin having a weight average molecular weight (Mw) of 1,500, a number average molecular weight (Mn) of 700, and a melting point (Tm) of 74° C.

Dimethyl terephthalate (97 parts), dimethyl isophthalate (78 parts), dodecenylsuccinic anhydride (27 parts), bisphenol A-ethylene oxide adduct (111 parts), bisphenol A-propylene oxide adduct (249 parts), and dibutyltin oxide (0.08 parts) were placed in a flask purged with nitrogen, and these monomers were reacted at 170° C. for four hours and then at 220° C. for two hours under reduced pressure, to prepare an amorphous resin having a weight average molecular weight (Mw) of 20,000, a number average molecular weight (Mn) of 9,000, and a glass transition point (Tg) of 59° C.

The crystalline resin (100 parts) was reacted with the amorphous resin (400 parts) in a flask under a nitrogen stream at 200° C. for two hours, followed by further reaction under reduced pressure for two hours, to prepare a block copolymer (490 parts) having a weight average molecular weight (Mw) of 23,200, a number average molecular weight (Mn) of 11,200, and a melting point (Tm) of 64° C.

Sodium dodecylbenzenesulfonate (soft type) or surfactant (0.5 parts) and deionized water (300 parts) were added to the block polymer (100 parts), and the mixture was heated at 80° C. and thoroughly agitated in a round glass flask with a homogenizer ULTRA-TURRAX T50 (manufactured by IKA). The pH of the reaction system was adjusted to 5.0 with 0.5 mol/L aqueous sodium hydroxide solution, and then the reaction system was heated to 90° C. while the agitation was continued with the homogenizer, to prepare a block polymer dispersion having a solid content of 20%.

The block polymer particles contained in the dispersion had a volume median particle size (D50) of 200 nm.

[Amorphous Polyester Resin Particle Dispersion]

Bisphenol A-propylene oxide (2 mol) adduct (500 parts by mass), terephthalic acid (103 parts by mass), fumaric acid (72 parts by mass), trimellitic acid (49 parts by mass), and an esterification catalyst (tin octylate) (2 parts by mass) were placed in a 10-L four-neck flask equipped with a nitrogen feeding tube, a dehydration tube, an agitator, and a thermocouple. Polycondensation reaction was allowed to proceed at 230° C. for eight hours, followed by further reaction at 8 kPa for one hour, to prepare an amorphous polyester resin. The amorphous polyester resin had a glass transition point (Tg) of 60° C., a softening point (Tsp) of 105° C., and a weight average molecular weight (Mw) of 40,000.

A 3-L jacketed reactor (BJ-30N, manufactured by TOKYO RIKAKIKAI CO., LTD.) equipped with a condenser, a thermometer, a water dropper, and an anchor blade was maintained at 40° C. in a water-circulating thermostatic bath, and a mixture of ethyl acetate (160 parts by mass) and isopropyl alcohol (100 parts by mass) was placed in the reactor. The amorphous polyester resin (300 parts by mass) was then placed in the reactor and dissolved in the solvent mixture under agitation with Three-One Motor at 150 rpm, to prepare an oil phase. 10 Mass % aqueous ammonia (14 parts by mass) was added dropwise to the agitated oil phase over five minutes, and the resultant mixture was agitated for 10 minutes. Thereafter, deionized water (900 parts by mass) was added dropwise to the mixture at a rate of 7 parts by mass/minute for phase inversion, to prepare an emulsion.

Immediately thereafter, the resultant emulsion (800 parts by mass) and deionized water (700 parts by mass) were placed in a 2-L recovery flask, and the flask was attached via a trap ball to an evaporator (manufactured by TOKYO RIKAKIKAI CO., LTD.) equipped with a vacuum controlling unit. While being rotated, the recovery flask was heated in a hot water bath at 60° C. and evacuated to 7 kPa with careful attention to bumping, to remove the solvent. After the recovery of the solvent in an amount of 1,100 parts by mass, the recovery flask was returned to ambient pressure and cooled with water, to yield a dispersion. The dispersion had no odor of solvent. The resin particles contained in the dispersion had a volume median particle size (D50) of 130 nm. Deionized water was then added to the dispersion for adjustment of the solid content to 20 mass %, to prepare an amorphous polyester resin particle dispersion.

[Colorant Particle Dispersion]

Sodium dodecyl sulfate (90 parts by mass) was dissolved in deionized water (1,600 parts by mass) with agitation, and MOGUL L (carbon black) (manufactured by Cabot Corporation) (420 parts by mass) was gradually added to the solution with agitation. The carbon black was then dispersed in the solution with an agitator CLEARMIX (manufactured by M Technique Co., Ltd.), to prepare a colorant particle dispersion. The colorant particles contained in the dispersion had a volume median particle size of 117 nm.

[Toner (1)]

The styrene-acrylic resin particle dispersion (260 parts by mass in terms of solid content) and deionized water (2,000 parts by mass) were placed in a reactor equipped with an agitator, a temperature sensor, and a cooling tube. A 5 mol/L aqueous sodium hydroxide solution was added to adjust the pH of the dispersion to 10, and then the colorant particle dispersion (40 parts by mass in terms of solid content) was placed in the reactor. Subsequently, an aqueous solution of magnesium chloride (60 parts by mass) in deionized water (60 parts by mass) was added under agitation at 30° C. over 10 minutes. The resultant mixture was allowed to stand for three minutes, and then heated to 80° C. over 60 minutes. A mixture of the crystalline polyester resin particle dispersion (20 parts by mass in terms of solid content) and the block polymer particle dispersion (40 parts by mass in terms of solid content) was added to the reaction system over 30 minutes, and the growth of core particles was continued at 80° C.

The particle size of core particles was determined with a particle size analyzer Coulter Multisizer 3 (manufactured by Coulter Beckman, Inc.). After the volume median particle size (D50) reached 6.0 μm, the amorphous polyester resin particle dispersion (40 parts by mass in terms of solid content) was added over 30 minutes for formation of a shell layer. After the supernatant of the reaction mixture became clear, an aqueous solution of sodium chloride (190 parts by mass) in deionized water (760 parts by mass) was added to stop growth of the particles. The reaction system was then heated and agitated at 90° C. to promote fusion of the particles. After the average roundness of the toner particles was determined to be 0.945 with a roundness analyzer FPIA-2100 (manufactured by Sysmex Corporation) (4000 particles detected in a high-power field (HPF)), the reaction system was cooled to 30° C., to prepare an aqueous dispersion of the toner particles having a core-shell structure.

The aqueous toner particle dispersion was subjected to solid-liquid separation with a centrifuge, to prepare a wet toner cake. The toner cake was centrifugally washed with deionized water at 35° C. until the filtrate exhibited an electrical conductivity of 5 μS/cm. After washing, the toner cake was transferred to a flash jet dryer (manufactured by SEISHIN ENTERPRISE Co., Ltd.) and dried to a water content of 0.5 mass %.

Hydrophobic silica (number average primary particle size: 12 nm) (1 mass %) and hydrophobic titania (number average primary particle size: 20 nm) (0.3 mass %) were added to the dried toner particles and mixed together with a Henschel mixer, to prepare toner (1).

[Toners (2) to (10), (21), (22), and (24) to (27)]

Toners (2) to (10), (21), (22), and (24) to (27) were prepared as in toner (1), except that the amounts of the dispersions were adjusted to vary, for example, the block polymer content of the core particles, the content of the resin having a trimellitic acid-derived structure in the shell layer, and the ratio of the resin content of the shell layer to the total resin content of the toner particles as illustrated in Table 1.

[Toner (23)]

Toner (23) was prepared as in toner (1), except that the crystalline polyester resin particle dispersion was not added.

[Developers (1) to (10) and (21) to (27)]

Toner (1) to (10) and (21) to (27) were mixed with a silicone resin-coated ferrite carrier (volume average particle size: 60 μm) to prepare developers (1) to (10) and (21) to (27) (toner content: 6 mass % each).

In Table 1, the weight average molecular weight (Mw) of the resin contained in core particles was determined by use of a sample dispersion of core particles having a volume median particle size (D50) of 6.0 μm prepared during production of the toner. The weight average molecular weight (Mw) of the resin contained in the shell layer was determined by use of a sample of the amorphous polyester resin particle dispersion.

In Table 1, "StAc" denotes a styrene-acrylic resin, "CPEs" a crystalline polyester resin, and "APES" an amorphous polyester resin.

TABLE 1

| | Core | | | Shell | | | |
|---|---|---|---|---|---|---|---|
| Toner No. | Composition of resin | Block polymer content [Mass %] | Weight average Molecular weight of resin (Mw) | Composition of resin | Content of resin derived from trimellitic acid [Mass %] | Weight average Molecular weight of resin (Mw) | Ratio of resin content of shell to total resin content of toner [Mass %] |
| 1 | StAc/CPEs | 10 | 31000 | APEs | 8 | 40000 | 10 |
| 2 | StAc/CPEs | 10 | 31000 | APEs | 3 | 26000 | 10 |
| 3 | StAc/CPEs | 10 | 31000 | APEs | 15 | 48000 | 10 |
| 4 | StAc/CPEs | 0 | 33000 | APEs | 8 | 40000 | 10 |
| 5 | StAc/CPEs | 1 | 31000 | APEs | 8 | 40000 | 10 |
| 6 | StAc/CPEs | 20 | 30000 | APEs | 8 | 40000 | 10 |
| 7 | StAc/CPEs | 10 | 46000 | APEs | 8 | 40000 | 10 |
| 8 | StAc/CPEs | 10 | 21000 | APEs | 8 | 40000 | 10 |
| 9 | StAc/CPEs | 10 | 31000 | APEs | 15 | 48000 | 15 |
| 10 | StAc/CPEs | 10 | 31000 | APEs | 3 | 26000 | 5 |
| 21 | StAc/CPEs | 0 | 33000 | APEs | 3 | 26000 | 5 |
| 22 | StAc/CPEs | 25 | 29000 | APEs | 15 | 48000 | 15 |
| 23 | StAc | 10 | 32000 | APEs | 8 | 40000 | 10 |
| 24 | StAc/CPEs | 10 | 46000 | APEs | 15 | 48000 | 10 |
| 25 | StAc/CPEs | 10 | 21000 | APEs | 3 | 26000 | 10 |
| 26 | StAc/CPEs | 15 | 30000 | APEs | 15 | 48000 | 15 |
| 27 | StAc/CPEs | 5 | 31000 | APEs | 3 | 26000 | 5 |

[Metal Content]

The metal content of each of toners (1) to (10) and (21) to (27) was determined by acid digestion and ICP-OES as described below.

(Pretreatment)

A toner (3 parts by mass) was dispersed in 0.2 mass % aqueous polyoxyethylene phenyl ether solution (35 parts by mass). The dispersion was treated with an ultrasonic homogenizer US-1200T (manufactured by NIHONSEIKI KAISHA LTD.) at 25° C. for five minutes to remove an external additive from the toner surface, to prepare a sample for analysis.

The sample (100 mg) was placed in a closed microwave digester ETHOS 1 (manufactured by Milestone General K.K.) and then decomposed with sulfuric acid and nitric acid. Undecomposed residue was treated with, for example, hydrochloric acid, hydrofluoric acid, and hydrogen peroxide for elution of target components. The sample mixture was appropriately diluted with ultrapure water. This analysis involved the use of ultrapure reagents manufactured by Kanto Chemical Co., Inc.

(Analysis)

The pretreated sample mixture was placed in an inductively coupled plasma emission spectrometer SPS3520UV (SII NanoTechnology Inc.), to determine the content of a target metal (Al, Mg, or Fe) contributing to formation of ionic crosslinks in the binder resin. These target metals were detected at the following wavelengths:

Al: 167.079 nm

Mg: 279.553 nm

Fe: 259.940 nm

A calibration curve was prepared by use of a sample-free solution containing a metal standard solution for atomic absorption analysis (manufactured by Kanto Chemical Co., Inc.) and having the same acid concentration as the sample mixture.

Table 2 illustrates the results of analysis.

Only Mg was detected in toners (1) to (10) and (21) to (27). Thus, the metal content illustrated in Table 2 corresponds to the content of only Mg.

[Peak Top Molecular Weight (Mp) of Resin in Toner]

The peak top molecular weight of a resin contained in each of toners (1) to (10) and (21) to (27) was determined as describe below.

A sample (toner) was added to tetrahydrofuran (THF) (concentration: 1 mg/mL) and dispersed therein with an ultrasonic disperser at 40° C. for 15 minutes. The dispersion was then filtered through a membrane filter having a pore size of 0.2 μm to prepare a sample solution. The GPC analysis involved the use of a GPC apparatus HLC-8220 (manufactured by Tosoh Corporation) provided with a TSKguard column and three TSKgel SuperHZ-M columns (manufactured by Tosoh Corporation). While the columns were maintained at 40° C., the columns were supplied with tetrahydrofuran (carrier solvent) at a flow rate of 0.2 mL/min. The sample solution (10 μL) and the carrier solvent were injected into the GPC apparatus, and the sample was detected with a refractive index detector (RI detector). The molecular weight distribution of the sample was then calculated from a calibration curve prepared with monodispersed polystyrene standard particles. The calibration curve was prepared with ten polystyrene standard samples (manufactured by Pressure Chemical) having molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$.

The peak top molecular weight (Mp) of the resin was a molecular weight corresponding to the maximum of the peak having the maximum area (peak top) in the calculated molecular weight distribution of the resin.

[Light Transmittance of Toner Layer]

A commercial copier bizhub PRO C6550 (manufactured by KONICA MINOLTA BUSINESS TECHNOLOGIES, INC.) was used as an image-forming apparatus. The image-forming apparatus was modified such that an image was directly transferred onto a glass substrate from a developing sleeve, and the distance between the developing sleeve and a transfer unit was able to be adjusted for allowing a thick glass substrate to pass therebetween. In the apparatus, a paper feeding path was modified to prevent deformation of a glass substrate. Each of toners (developers) (1) to (10) and (21) to (27) was deposited (6.5±0.1 g/m$^2$) on a glass cover (MICRO COVER GLASS, 18 mm by 18 mm, manufactured by MUTO PURE CHEMICALS CO., LTD.) at 20° C. and 50% RH, to form a toner layer. The toner layer was covered with OK top coat 128 gsm (18 mm by 18 mm, thickness: 100±10 μm) having a central hole of 6 mmϕ. The glass cover was placed on a hot plate heated at 50° C. An OIML standard weight (cylindrical, 1 kg, M1) heated at 185° C. was placed on the OK top coat for five seconds so as to completely cover the hole of the OK top coat. Immediately thereafter, the glass cover was removed from the OK top coat and then cooled to room temperature. The light transmittance of the toner layer at 690 nm was determined with a UV-visible/NIR spectrophotometer UH4150 (manufactured by Hitachi, Ltd.). The light transmittance of only the cover glass (i.e., blank) was determined in the same manner as described above. The light transmittance (%) of the toner layer was calculated relative to that of the cover glass (taken as 100%). Table 2 illustrates the light transmittances (%) of layers of toners (1) to (10) and (21) to (27).

[Evaluation]

Each of toners (developers) (1) to (10) and (21) to (27) was evaluated for uniformity of image density and low-temperature fixing properties.

[Low-Temperature Fixing Properties]

A commercial color copier bizhub PRO C6500 (manufactured by KONICA MINOLTA, INC.) was modified such that the fixing temperature, the amount of a toner to be deposited, and the system rate were able to be adjusted. Each toner was evaluated for fixing properties in the modified apparatus. In detail, solid images (toner density: 11.3 g/m$^2$) were formed on sheets NPi (128 g/m$^2$) (manufactured by Nippon Paper Industries Co., Ltd.) with the modified apparatus. The temperature of a fixing belt was varied stepwise from 150° C. to 200° C. in 5° C. increments, and the temperature of a fixing roller was adjusted to be lower by 20° C. than that of the fixing belt. The fixation was performed at a rate of 300 mm/sec. The temperature of the fixing belt was measured during the fixation, and the minimum fixing temperature at which no cold offset occurred was determined.

A lower minimum fixing temperature indicates superior low-temperature fixing properties. The low-temperature fixing properties were evaluated on the basis of the criteria described below. A developer was practically acceptable which had a minimum fixing temperature of lower than 165° C.

A: A minimum fixing temperature of lower than 150° C.

B: A minimum fixing temperature of 150° C. or higher and lower than 165° C.

C: A minimum fixing temperature of 165° C. or higher

[Uniformity of Image Density]

A commercial color multifunctional printer bizhub PRESS C1100 (KONICA MINOLTA, INC.) was modified such that the surface temperatures of a fixing belt and a fixing roller were able to be varied within ranges of 140 to 220° C. and 120 to 200° C., respectively. Each toner was evaluated for uniformity of image density in the modified apparatus. In detail, solid images (toner density: 8.0 g/m$^2$) were formed on rough sheets Hammermill tidal (manufactured by Hammermill). The fixation was performed at rate of 460 mm/sec, and the fixing temperature (surface temperature of the fixing belt) was adjusted to be higher by 15° C. than the under offset temperature.

The solid images were visually observed for evaluation of uniformity of image density based on the following criteria:

A: No uneven image density

B: Slightly uneven image density but practically acceptable

C: Noticeably uneven image density and practically unacceptable

Table 2 illustrates the results of evaluation.

TABLE 2

| Toner No. | Mg content [Mass %] | Peak top molecular weight of resin in toner (Mp) | Light transmittance [%] | Low-temperature fixing properties | Uniformity of image density | Note |
|---|---|---|---|---|---|---|
| 1 | 0.15 | 16600 | 2.0 | A | A | Example |
| 2 | 0.05 | 16000 | 3.0 | A | A | Example |
| 3 | 0.25 | 17900 | 1.0 | B | A | Example |
| 4 | 0.07 | 16800 | 2.9 | A | B | Example |
| 5 | 0.09 | 16600 | 2.7 | A | B | Example |
| 6 | 0.24 | 16300 | 1.1 | B | A | Example |
| 7 | 0.14 | 21100 | 1.2 | B | B | Example |
| 8 | 0.21 | 13900 | 2.9 | A | B | Example |
| 9 | 0.28 | 18500 | 1.1 | B | B | Example |
| 10 | 0.03 | 15000 | 2.9 | A | B | Example |
| 21 | 0.05 | 15700 | 3.2 | A | C | Comparative Example |
| 22 | 0.25 | 17400 | 0.8 | C | B | Comparative Example |
| 23 | 0.18 | 16700 | 0.9 | C | C | Comparative Example |
| 24 | 0.23 | 21400 | 0.9 | C | B | Comparative Example |
| 25 | 0.08 | 13500 | 3.1 | A | C | Comparative Example |
| 26 | 0.26 | 20000 | 0.9 | C | A | Comparative Example |
| 27 | 0.04 | 14500 | 3.1 | A | C | Comparative Example |

As illustrated in Table 2, each of toners (1) to (10) (light transmittance of a layer of the toner under the aforementioned heating conditions: 1 to 3%) exhibited substantially no uneven image density and superior low-temperature fixing properties.

This U.S. patent application claims priority to Japanese Patent Application No. 2016-059379 filed on Mar. 24, 2016, the entire contents of which are incorporated by reference herein.

What is claimed is:

1. A toner for developing an electrostatic image, comprising a toner particle, wherein the toner particle includes a binder resin and a black colorant, the binder resin including a crystalline resin component, a block polymer component, and a styrene-acrylic resin component, the crystalline resin component includes a crystalline polyester resin, the block polymer component has a crystalline segment and an amorphous segment, the toner particle is coated with a shell layer, wherein the shell layer includes an amorphous polyester resin, and a toner layer formed through a deposition of the toner on a glass sheet in an amount of 6.5 $g/m^2$ exhibits a light transmittance of 1 to 3% at a wavelength of 690 nm after applying heat at a temperature of 185° C. for five seconds to the toner layer from a position 100 μm away from a surface of the toner layer.

2. The toner for developing an electrostatic image according to claim 1, wherein the resin contained in the toner particle has a peak top molecular weight of 14,000 to 21,000.

3. The toner for developing an electrostatic image according to claim 1, wherein the crystalline resin component has a melting point of 65° C. to 85° C.

4. The toner for developing an electrostatic image according to claim 1, wherein the toner particle includes the block polymer component in an amount of 1 to 20 mass %.

5. The toner for developing an electrostatic image according to claim 1, wherein the crystalline segment has a weight average molecular weight of 1,000 to 3,000, and the amorphous segment has a weight average molecular weight of 10,000 to 40,000.

6. The toner for developing an electrostatic image according to claim 1, wherein the crystalline segment is a resin segment including a structure derived from a crystalline polyester resin.

7. The toner for developing an electrostatic image according to claim 1, wherein the toner particle includes a metal that forms ionic crosslinks in the binder resin, and the metal content of the toner particle is 0.05 to 0.25 mass %.

8. The toner for developing an electrostatic image according to claim 1, wherein the binder resin contained in the toner particle includes a polyester resin component having a structure derived from trimellitic acid.

9. The toner for developing an electrostatic image according to claim 1, wherein the binder resin includes the styrene-acrylic resin component in an amount of 5 mass % or more.

10. The toner for developing an electrostatic image according to claim 1, wherein the shell layer includes a polyester resin having a structure derived from trimellitic acid.

11. The toner for developing an electrostatic image according to claim 10, wherein the content of the polyester resin having the structure derived from trimellitic acid is 3 to 15 mass % relative to the entire resin contained in the shell layer.

* * * * *